US012622457B2

(12) United States Patent
Nelson et al.

(10) Patent No.: US 12,622,457 B2
(45) Date of Patent: May 12, 2026

(54) REPLACEABLE MOUTHPIECES FOR AEROSOL-GENERATING DEVICES

(71) Applicant: Altria Client Services LLC, Richmond, VA (US)

(72) Inventors: Gregory Lee Nelson, Chester, VA (US); Nam Tran, North Chesterfield, VA (US); Dean Twite, London (GB); Oliver De Roeck, Hertfordshire (GB)

(73) Assignee: Altria Client Services LLC, Richmond, VA (US)

( * ) Notice: Subject to any disclaimer, the term of this patent is extended or adjusted under 35 U.S.C. 154(b) by 609 days.

(21) Appl. No.: 17/979,103

(22) Filed: Nov. 2, 2022

(65) Prior Publication Data

US 2024/0138472 A1 May 2, 2024

(51) Int. Cl.
*A24F 7/02* (2006.01)
*A24F 40/40* (2020.01)

(52) U.S. Cl.
CPC ..... *A24F 7/02* (2013.01); *A24F 40/40* (2020.01)

(58) Field of Classification Search
None
See application file for complete search history.

(56) References Cited

U.S. PATENT DOCUMENTS

| | | | | |
|---|---|---|---|---|
| 4,046,153 | A | 9/1977 | Kaye | |
| 10,813,386 | B1 * | 10/2020 | Bajpai | A24F 1/30 |
| 11,297,876 | B2 | 4/2022 | Brinkley et al. | |
| 2021/0016019 | A1 | 1/2021 | Carrubba et al. | |
| 2021/0307392 | A1 | 10/2021 | Rosser | |
| 2022/0046993 | A1 * | 2/2022 | Liu | A24F 40/10 |
| 2022/0225669 | A1 | 7/2022 | Hawes et al. | |
| 2022/0312838 | A1 * | 10/2022 | Potter | A24F 40/42 |

FOREIGN PATENT DOCUMENTS

| | | | | |
|---|---|---|---|---|
| CN | 112674393 | A | 4/2021 | |
| CN | 216255459 | U | 4/2022 | |
| CN | 217609535 | U | 10/2022 | |
| WO | WO-2012155058 | A1 * | 11/2012 | A61M 11/002 |
| WO | WO-2020/63082 | A1 | 4/2020 | |
| WO | WO-2020/199950 | A1 | 10/2020 | |
| WO | WO-2021/196113 | A1 | 10/2021 | |

OTHER PUBLICATIONS

International Search Report and Written Opinion dated Feb. 8, 2024, regarding Application No. PCT/US2023/078436.

* cited by examiner

*Primary Examiner* — Jill A Warden

(57) ABSTRACT

The replaceable mouthpiece includes a body having a first body end and a second body end. The first body end defines an outlet. The second body end defines a first opening coupleable to the aerosol-generating device. The replaceable mouthpiece includes two or more pillars disposed within the body and extending towards the second body end.

14 Claims, 17 Drawing Sheets

REPLACEABLE MOUTHPIECES FOR AEROSOL-GENERATING DEVICES

BACKGROUND

Field

The present disclosure relates to replaceable mouthpieces for use with aerosol-generating devices.

Description of Related Art

Some electronic devices are configured to heat a plant material to a temperature that is sufficient to release constituents of the plant material while keeping the temperature below a combustion point of the plant material so as to avoid any substantial pyrolysis of the plant material. Such devices may be referred to as aerosol-generating devices (e.g., heat-not-burn aerosol-generating devices), and the plant material heated may be tobacco and/or cannabis. In some instances, the plant material may be introduced directly into a heating chamber of an aerosol-generating device. In other instances, the plant material may be pre-packaged in individual containers to facilitate insertion and removal from an aerosol-generating device.

SUMMARY

At least some example embodiments relate to replaceable mouthpieces for use with aerosol-generating devices, such as heat-not-burn aerosol-generating device.

In at least one example embodiment, the replaceable mouthpiece may include a body having a first body end and a second body end. The first body end may define an outlet. The second body end may define a first opening coupleable to the aerosol-generating device. The replaceable mouthpiece may also include two or more pillars disposed within the body and extending towards the second body end.

In at least one example embodiment, the two or more pillars may extend from an interior surface of the body towards the second body end.

In at least one example embodiment, each of the two or more pillars may have a first pillar end and a second pillar end. The first pillar end may be coupled to and extend from an interior surface of the body nearer to the first body end, while the second pillar end may be unattached to the body.

In at least one example embodiment, the replaceable mouthpiece may include four pillars that together form a discontinuous shape that mirrors the shape of the outlet.

In at least one example embodiment, the replaceable mouthpiece may further include a seal defining a second opening. The seal may be configured to engage the second body end such that the first opening and the second opening at least partially align.

In at least one example embodiment, the seal may include a ridge that defines the second opening and a lip that extends perpendicularly from the ridge.

In at least one example embodiment, the ridge may be received by the second body end and the lip may join a ledge of the replaceable mouthpiece that is configured to position the replaceable mouthpiece with respect to a lid of the aerosol-generating device.

In at least one example embodiment, the lip may be parallel with the ledge of the replaceable mouthpiece.

In at least one example embodiment, two or more pillars may be configured to contact at least a portion of the ridge when the seal is received by the second body end.

In at least one example embodiment, the ridge may include a shelf that extends along an interior perimeter of the ridge.

In at least one example embodiment, the two or more pillars may be configured to contact the shelf at one or more locations.

In at least one example embodiment, the outlet may include one or more projections ending from the first body end towards the second body end.

In at least one example embodiment, the one or more projections may include a recessed portion extending along a perimeter of the outlet and two or more protrusions extending from the recessed portion towards the second body end.

In at least one example embodiment, the one or more protrusions may include a first protrusion. The one or more protrusions may also include a second protrusion that is parallel with the first protrusion.

In at least one example embodiment, a first bridge may connect the first protrusion and the second protrusion.

In at least one example embodiment, the first bridge may be concave with respect to the outlet.

In at least one example embodiment, the one or more protrusions may further include a third protrusion. The one or more protrusions may also include a fourth protrusion that is parallel with the third protrusion.

In at least one example embodiment, a second bridge may connect the third protrusion and the fourth protrusion. A first center point of the first bridge may intersect with a second center point of the second bridge.

In at least one example embodiment, the second bridge may be concave with respect to the outlet.

In at least one example embodiment, the first body end may include a rim that ends along a perimeter of the first body end and a recessed surface that extends inwardly from the rim and that defines the outlet.

In at least one example embodiment, the body may further include one or more coupling structures disposed on an exterior surface of the body and configured to couple the replaceable mouthpiece to a lid of the aerosol-generating device.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION OF EXAMPLE EMBODIMENTS

Figure 1:
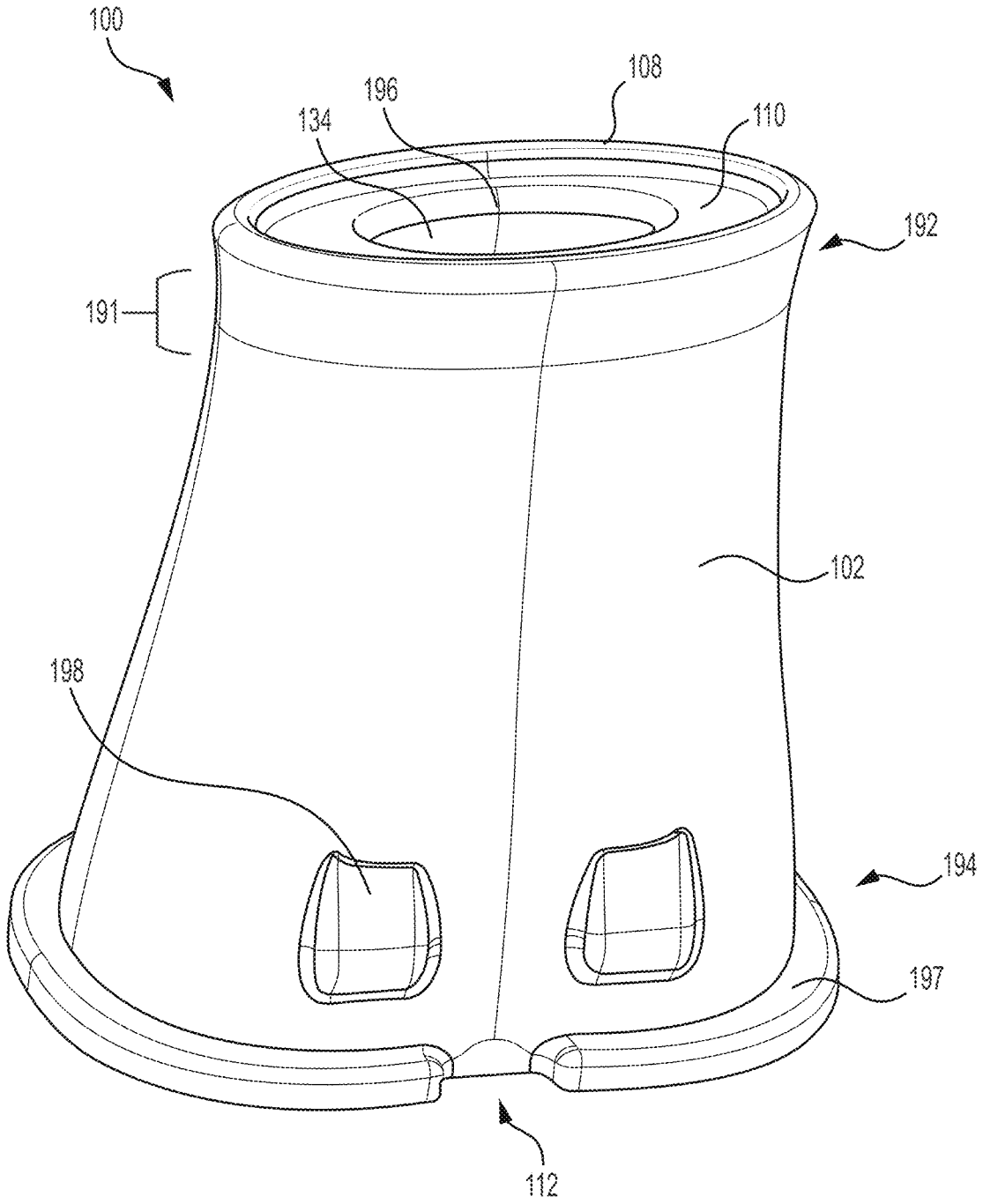
FIG. 1 is a top right, front perspective view of an example replaceable mouthpiece to be used in an aerosol-generating device in accordance with at least one example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, component, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," specify the presence of stated features, integers, steps, operations, and/or elements, but do not preclude the presence or addition of one or more other features, integers, steps, operations, elements, and/or groups thereof.

When the terms "about" or "substantially" are used in this specification in connection with a numerical value, it is intended that the associated numerical value includes a manufacturing or operational tolerance (e.g., ±10%) around the stated numerical value. Moreover, when the terms "generally" or "substantially" are used in connection with geometric shapes, it is intended that precision of the geometric shape is not required but that latitude for the shape is within the scope of the disclosure. Furthermore, regardless of whether numerical values or shapes are modified as "about," "generally," or "substantially," it will be understood that these values and shapes should be construed as including a manufacturing or operational tolerance (e.g., ±10%) around the stated numerical values or shapes.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

As used herein, "coupled" includes both removably coupled and permanently coupled. For example, when an elastic layer and a support layer are removably coupled to one another, the elastic layer and the support layer can be separated upon the application of sufficient force.

Figure 2:
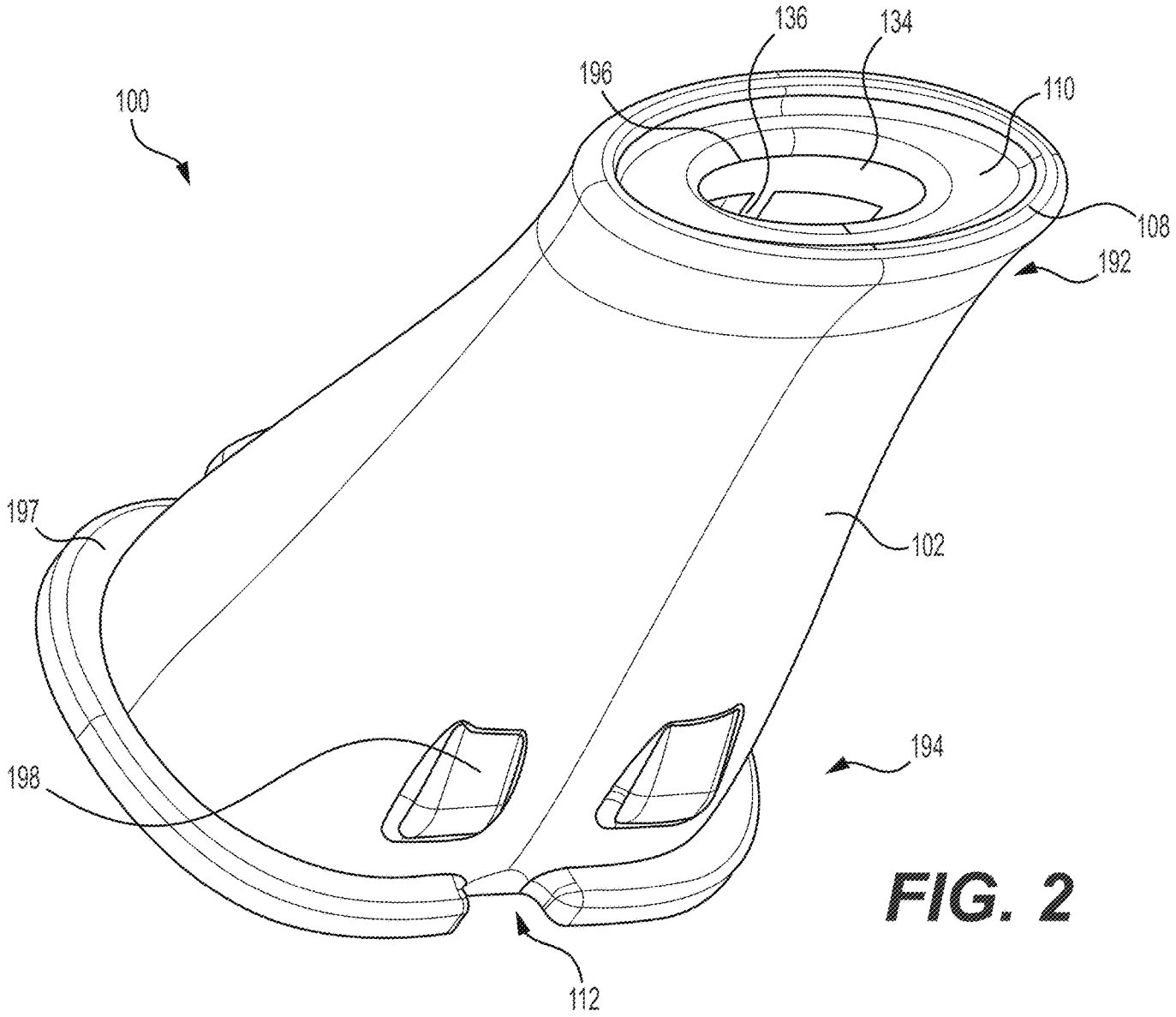
FIG. 2 is a top right, side perspective view of the example replaceable mouthpiece illustrated in FIG. 1.
Figure 3:
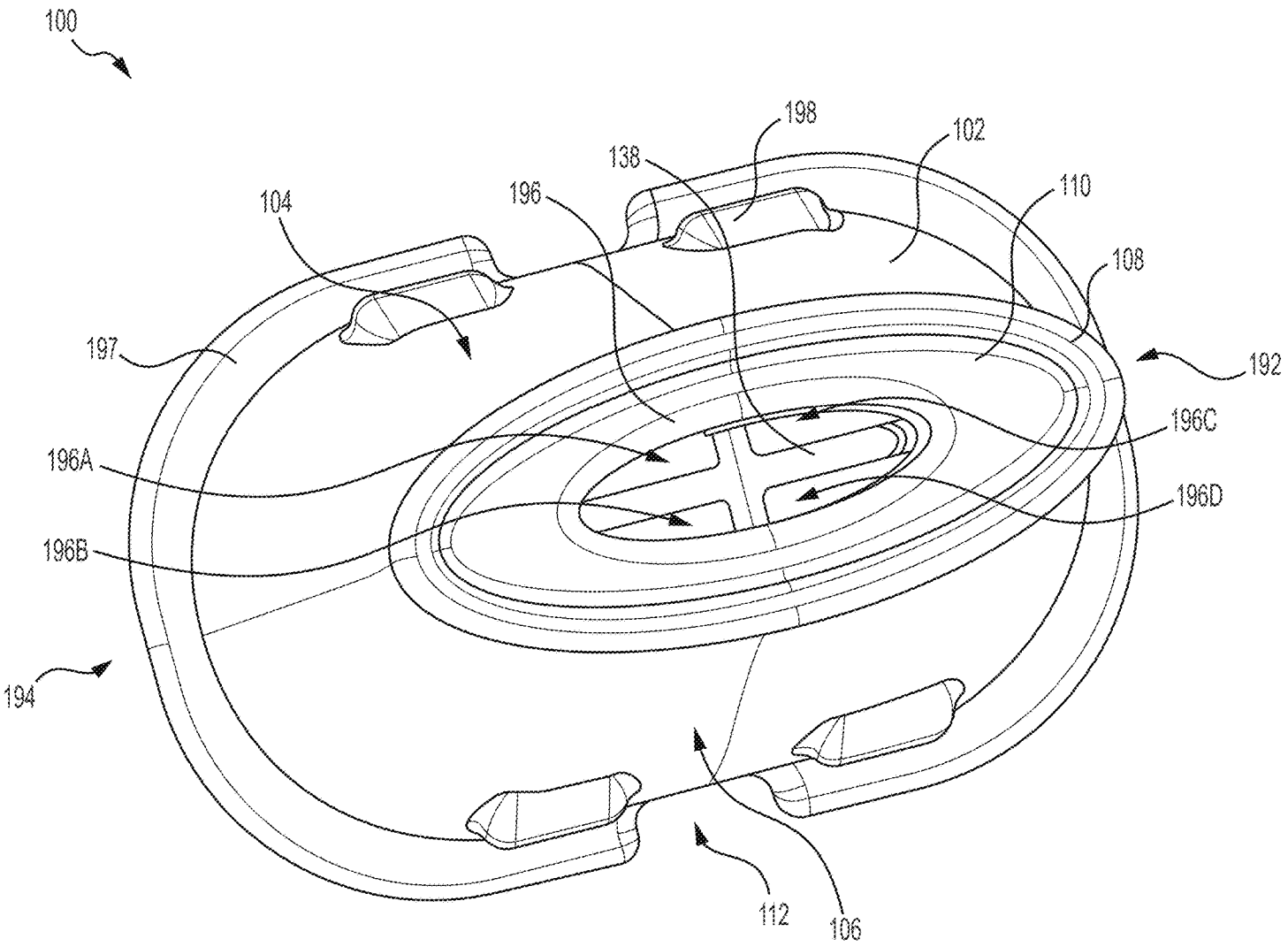
FIG. 3 is a top-down perspective view of the example replaceable mouthpiece illustrated in FIG. 1.

FIGS. 1-12 are illustrations of a replaceable mouthpiece 100 to be used in an aerosol-generating device in accordance with at least one example embodiment. For example, FIG. 1 is a top right, front perspective view of the replaceable mouthpiece 100, and FIG. 2 is a top right, side perspective view of the replaceable mouthpiece 100. As illustrated, the replaceable mouthpiece 100 includes a body 102 having a first body end 192 and a second body end 194 distal from the first body end 192. In at least one example embodiment, the body 102 may be generally tapered between the first body end 192 and the second body end 194. For example, the diameter or average length/width dimensions of the first body end 192 may be smaller than the diameter or average length/width dimensions of the second body end 194. Towards the first body end 192, the body 102 may further have a slight inward curvature 191 that is configured to receive the lips of an adult consumer and improve the comfort and experience.

The first body end 192 may have an oblong or elliptical shape and includes an outlet 196. For example, the outlet 196 may be disposed on (for example, formed within) a horizontal (e.g., as shown in FIG. 1) surface 110 of the first body end 192. Like the first body end 192, the outlet 196 may also have oblong or elliptical shape. Although only one shape is illustrated, it should be understood that, in some example embodiments, the first body end 192 and/or the outlet 196 may take a variety of other shapes and configurations. In at least one example embodiment, as best illustrated, for example, in FIG. 3, which is a top-down perspective view of the replaceable mouthpiece 100, the outlet 196 may be sub-divided into one or more sections (or portions) 196A, 196B, 196C, 196D. For example, in at least one example embodiment, as illustrated, the outlet 196 may be divided into four sections 196A, 196B, 196C, 196D. The one or more sections 196A, 196B, 196C, 196D may take a variety of sizes and shapes and may be selected such that one or more different areas (or quadrants) of the adult consumer's mouth can be engaged during use of the replaceable mouthpiece 100.

In at least one example embodiment, the first body end 192 may include a rim 108 that extends along a perimeters of the first body end 192. For example, the rim 108 may be a substantially continuous ridge that extends above the first body end 192. Although, a continuous ridge is illustrated, it should be recognized that in some example embodiments, the rim 108 may have a discontinuous configuration. In at least one example embodiment, as illustrated, the horizontal surface 110 may be a recessed surface that extends inwardly from the rim 108 and defines the outlet 196. The step (or recess) relationship of the rim 108 and the horizontal surface 110 of the first body end 192 may help to prevent the adult consumer from directly contacting the outlet 196 and also allows any lingering condensation to condense within the recessed area helping to further reduce the adult consumer from experiencing the effects of the lingering condensation, further enhancing sensorial experience.

Like the first body end 192, the second body end 194 may take a variety of shapes and configurations. For example, as illustrated, the second body end 194, like the first body end 192, may have an oblong or elliptical shape. In each variation, the second body end 194 is coupleable to a lid of the aerosol-generating device. For example, in at least one example embodiment, the second body end 194 may include a ledge 197. As illustrated, the ledge 197 may be a discontinuous structure that surrounds (for example, extends from) a perimeter of the second body end 194. For example, as illustrated, the ledge 197 may include one or more breaks (or spaces) 112 disposed along its length to actuate and/or improve coupling with the lid of the aerosol-generating device. Although not illustrated, it should be recognized that, in some example embodiments, the ledge 197 may be a substantially continuous structure that surrounds (for example, extends from) a perimeters of the second body end 194.

In at least one example embodiment, the second body end 194 may include one or more coupling structures 198. For example, the replaceable mouthpiece 100 may include one or more coupling structures 198 spaced apart and disposed on a first side (or first major length) 104 of the replaceable mouthpiece and one or more coupling structures 198 spaced apart and disposed on a second side (or second major length) 106 of the replaceable mouthpiece 100. The first and second sides 104, 106 of the replaceable mouthpiece 100 may be substantially parallel. In some example embodiments, as illustrated, the first side 104 may include two coupling structures 198, and the second side 106 may include two coupling structures 198. In each instance, the one or more coupling structures 198 may be configured to assist the coupling of the replaceable mouthpiece 100 to the lid of the aerosol-generating device. In at least one example embodiments, the one or more coupling structures 198 may be bubble (or projection) couplers.

The replaceable mouthpiece 100 may be received by a cavity (or opening) of the lid of the aerosol-generating device. The lid may be configured to receive and secure the second body end 194 of the replaceable mouthpiece 100 (for example, via a snap-fit arrangement). For example, in at least one example embodiment, the ledge 197 may be adjacent an interior surface of the lid of the aerosol-generating device and the one or more coupling structures 198 may be received by one or more corresponding structures formed on an interior surface of the lid of the aerosol-generating device. In at least one example embodiment, the ledge 197 and the one or more coupling structures 198 may be covered by the lid of the aerosol-generating device when assembled with the aerosol-generating device. For example, when assembled, only a portion of the body 102 may be visible. In each instances, the aerosol-generating device may be as described in U.S. application Ser. No. 17/947,436, titled "Heat-Not-Burn (HNB) Aerosol-Generating Devices and Capsules", as filed Sep. 19, 2022.

Figure 4:
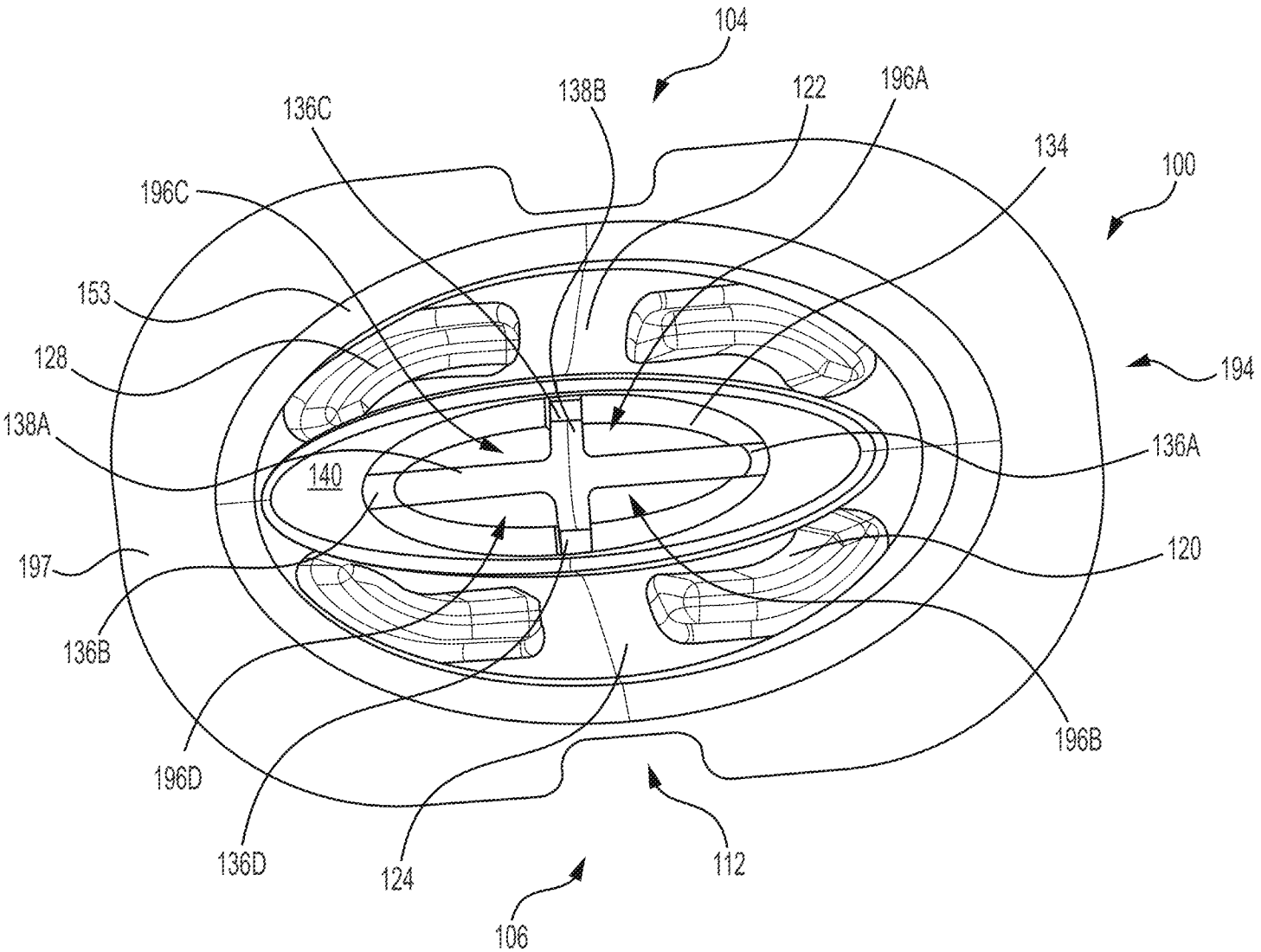
FIG. 4 is a bottom view of the example replaceable mouthpiece illustrated in FIG. 1.
Figure 5:
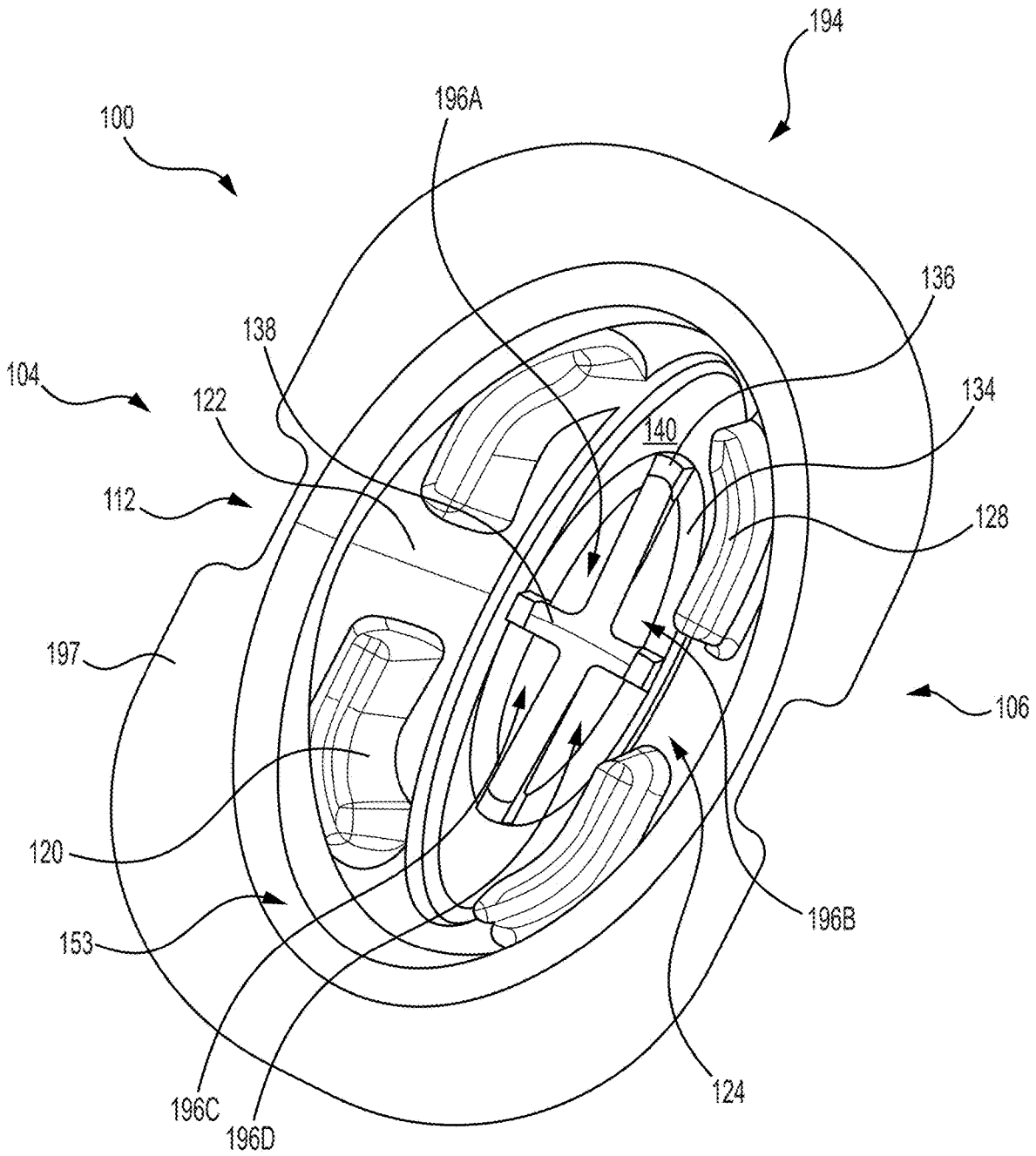
FIG. 5 is a bottom perspective view of the example replaceable mouthpiece illustrated in FIG. 1.
Figure 6:
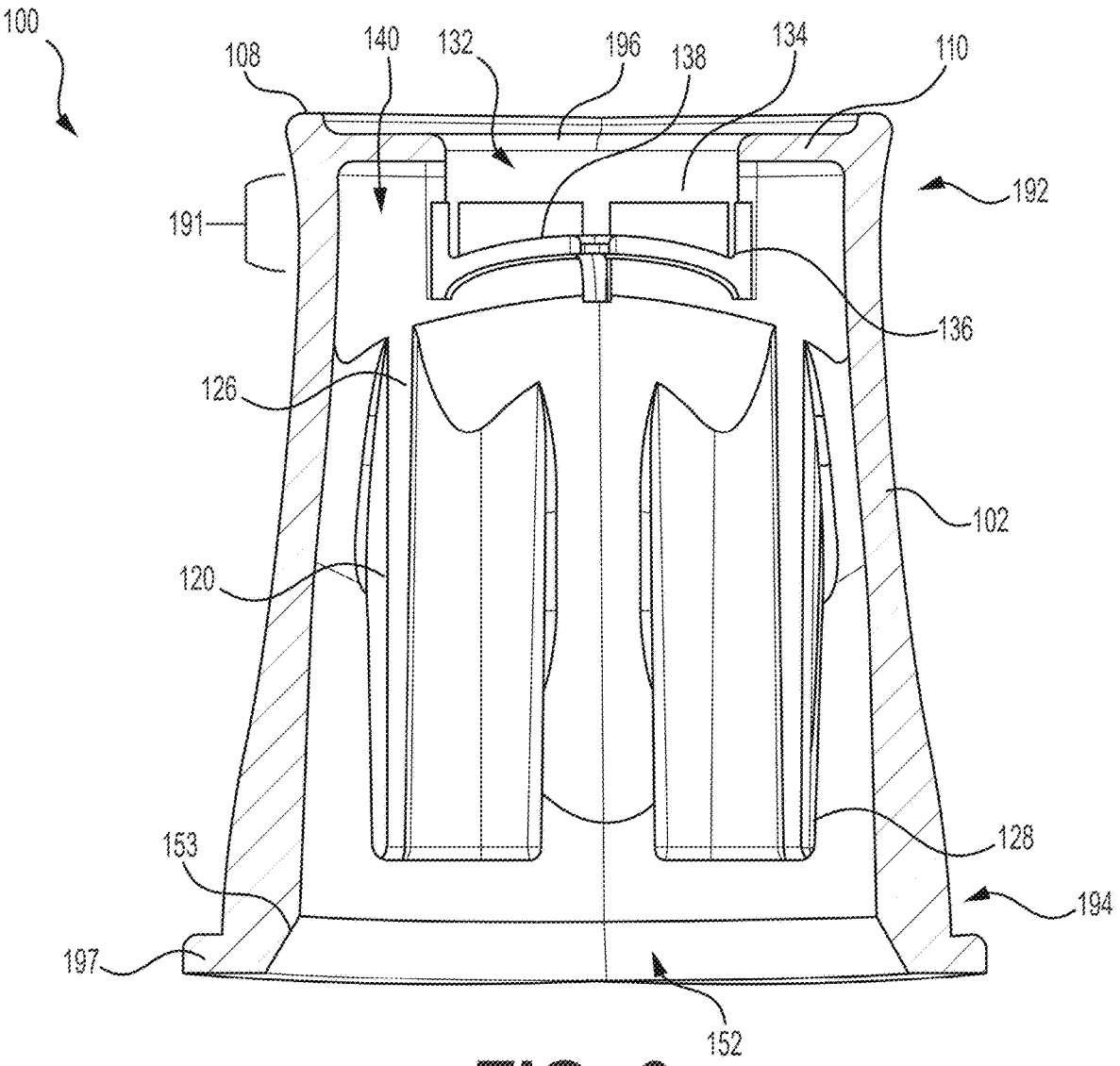
FIG. 6 is a cross-sectional view of the example replaceable mouthpiece illustrated in FIG. 1.

FIG. 4 is a bottom view of the replaceable mouthpiece 100; FIG. 5 is a bottom perspective view of the replaceable mouthpiece 100; and FIG. 6 is a cross-sectional view of the replaceable mouthpiece. As illustrated, the replaceable mouthpiece 100 may include two or more pillars (or protrusions or bosses) 120 disposed within the body 102. The two or more pillars 120 may extend from an interior surface 122, 124 of the body 102 towards the second body end 194. For example, in at least one example embodiment, as illustrated, a first pillar end 126 of each of the two or more pillars 120 may be connected to the interior surface 122, 124 of the body 102, while a second pillar end 128 of each of the two or more pillars 120 may be unattached (i.e., not coupled to the interior surface 122, 124 of the body 102). Although not illustrated, it should be recognized that in some example embodiments, the two or more pillars 120 may be connected along its entire length to the interior surface 122, 124.

In at least one example embodiment, as illustrated, the replaceable mouthpiece 100 may include four pillars 120. For example, the replaceable mouthpiece 100 may include two pillars 120 extending from a portion of an interior surface 122 of the first side 104 of the body 102 near the first body end 192 and towards the second body end 194 and two pillars 120 extending from a portion of an interior surface 124 of the second side 106 of the body 102 near the first body end 102 and towards the second body end 194. In each instance, the two or more pillars 120 may be disposed to form a discontinuous shape that mirrors the shape of the outlet 196 and may be configured to apply a pressure to a capsule received by the aerosol-generating device. The discontinuous shape and placement of the two or more pillars 120 may reduce overall surface area in (direct) contact with a central aerosol path within the replaceable mouthpiece 100, such that as an aerosol (or other substance) moves from the aerosol-generating device (or other device) into the replaceable mouthpiece 100 condensation is limited (for example, by allowing more time for the aerosol to cool prior to contacting the interior surfaces of the replaceable mouthpiece 100) and that any condensation that does form is directed (i.e., flows down) to cooler areas of the aerosol-generating device away from the heated section, which is generally aligned with a center of the replaceable mouthpiece 100 when coupled with the aerosol-generating device, thereby preventing the condensation from re-entering the aerosol stream.

Figure 7:
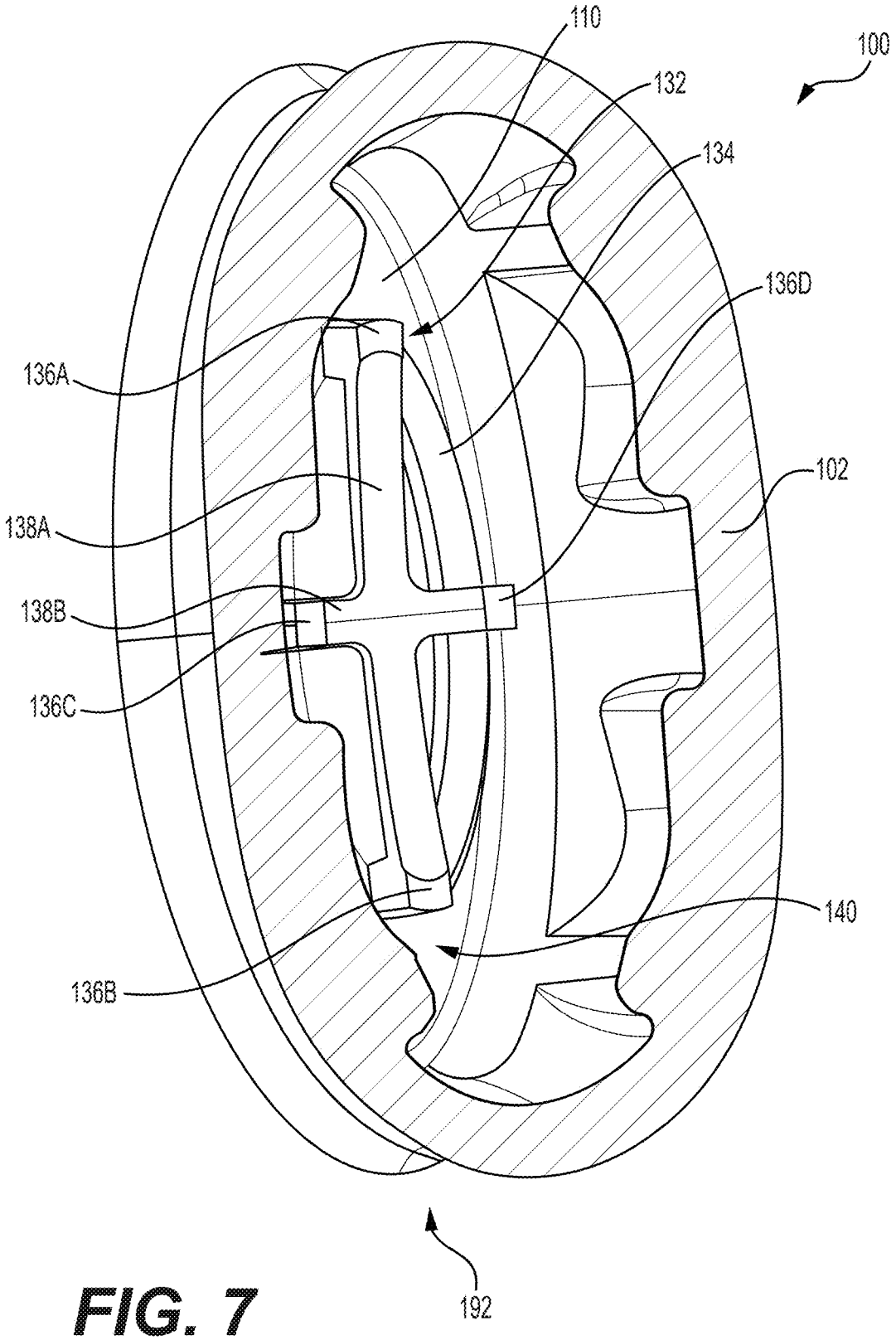
FIG. 7 is a cross-sectional, perspective view of the example replaceable mouthpiece illustrated in FIG. 1.
Figure 8:
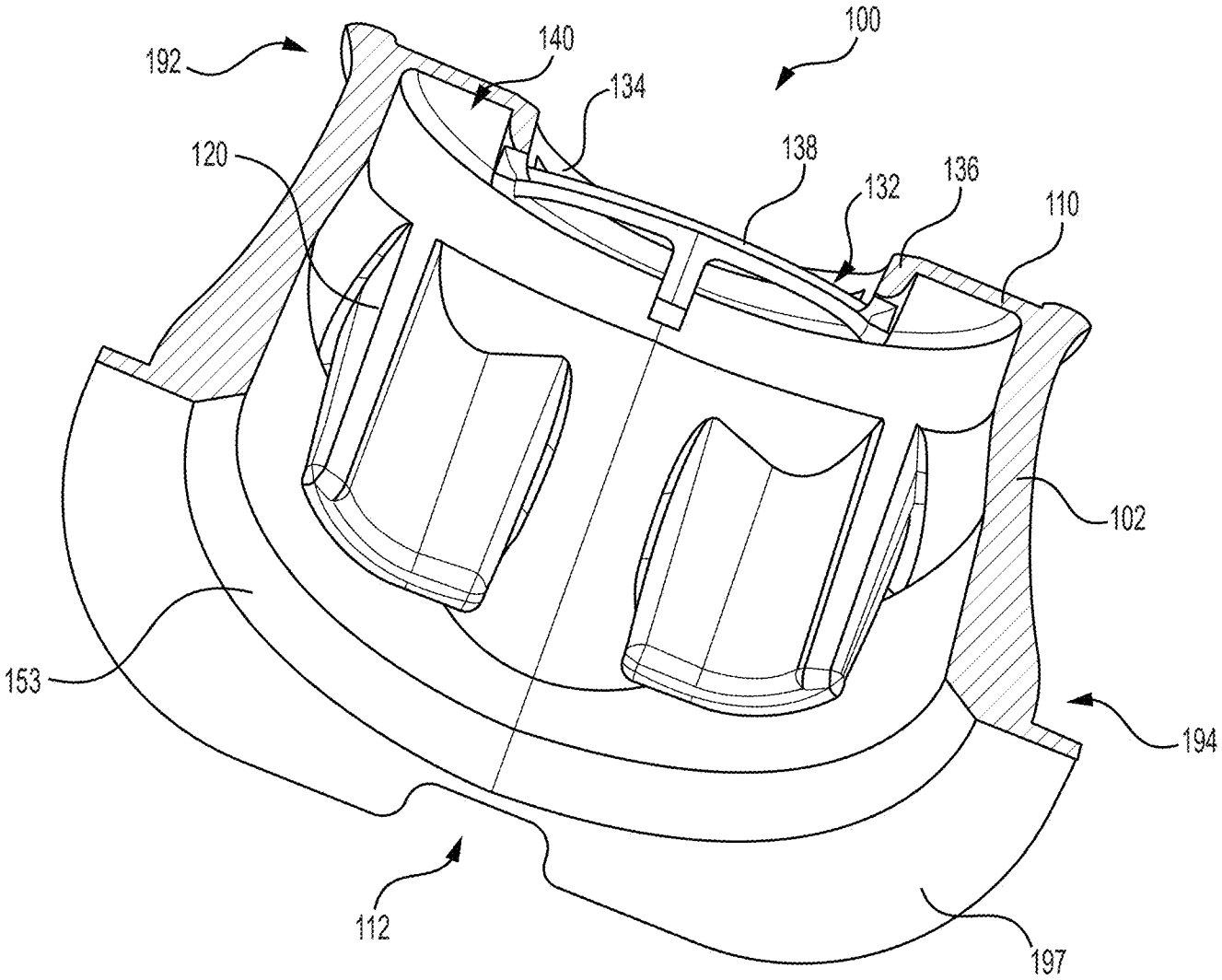
FIG. 8 is another cross-sectional, perspective view of the example replaceable mouthpiece illustrated in FIG. 1.
Figure 9:
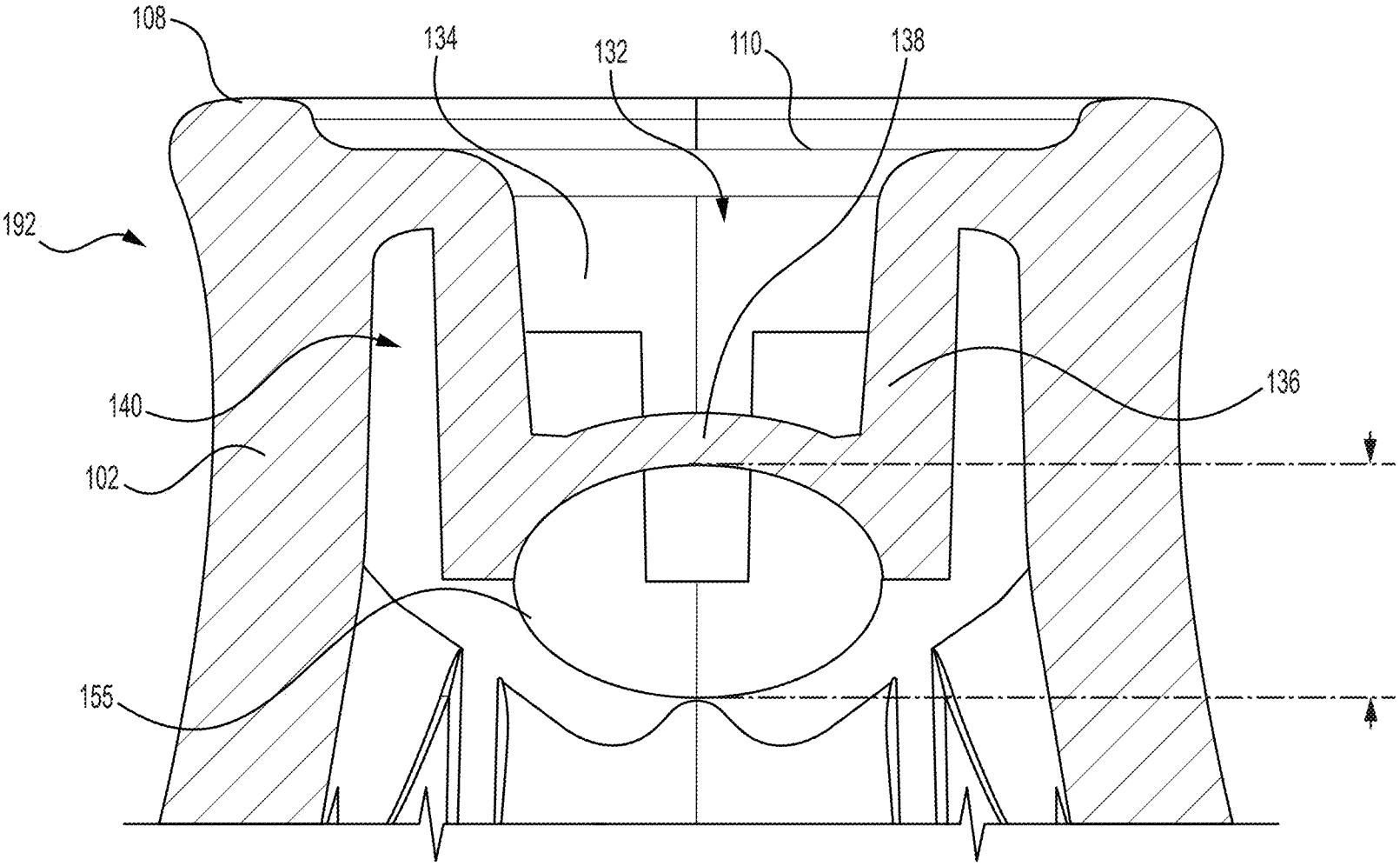
FIG. 9 is another cross-sectional, partial view of the example replaceable mouthpiece illustrated in FIG. 1.

FIG. 7 is a cross-sectional, perspective view of the replaceable mouthpiece 100; FIG. 8 is another cross-sectional, perspective view of the replaceable mouthpiece 100; and FIG. 9 is another cross-sectional, partial view of the first body end 192 of the replaceable mouthpiece 100. As illustrated, the outlet 196 may include one or more projections 132 that extend from the horizontal surface 110 of the first body end 192 towards the second body end 194. In at least one example embodiment, the one or more projections 132 may include, for example, a recessed (or rim) portion 134 extending along a perimeter of the outlet 196 in the direction of the second body end 194. The recessed portion 134 is recessed relative to the first body end 192, and more particularly, the horizontal surface 110. As illustrated, the recessed portion 134 may be a substantially continuous structure that extends along an entire length of the perimeter of the outlet 196. Although not illustrated, it should be recognized that, in some example embodiments, the recessed portion 134 may be a discontinuous structure that extends along a length of the perimeter of the outlet 196.

In at least one example embodiment, the one or more projections 132 may include, in addition to, or instead of, the recessed portion 134, one or more protrusions 136. For example, in at least one example embodiment, as illustrated, the one or more protrusions 136 may extend from the recessed portion 134 towards the second body end 194. In at least one example embodiment, the one or more projections 132 may further include one or more bridges 138 that connect the one or more protrusions 136. As illustrated, in at least one example embodiment, at least one of the one or more bridges 138 may have a curved shape. For example, as illustrated, each of the one or more bridges 138 may have a concave shape with respect to the outlet 196. In FIG. 9, a representative ellipse 155 is drawn on top of the replaceable mouthpiece 100 to represent the curvature of the bridges 138. A radius of the representative ellipse 155 may be about 10 millimeters. The curvature of the one or more bridges 138 may create a multiplane geometry that helps to limit the formation of condensation. For example, the multiplane geometry may move interior surfaces of the outlet 196 away from each other, such that fewer linear surfaces exist, and it is harder for droplets to form on and move between the interior surfaces.

In at least one example embodiment, as illustrated, the one or more protrusions 136 may include a first protrusion 136A and a second protrusion 136B that is substantially parallel with the first protrusion 136A and a first bridge 138A that connects a distal (or second) end of the first protrusion 136A to a distal (or second) end of the second protrusion 136B. A proximal (or first) end of the first protrusion 138A may be connected to the recessed portion 134 and the distal end of the first protrusion 136A may extend towards the second body end 194. A proximal (or first) end of the second protrusion 136B may be connected to the recessed portion 134 and the distal end of the second protrusion 136B may extend towards the second body end 194.

In at least one example embodiment, in addition to, or instead of, the first protrusion 136A and the second protrusion 136B, the one or more protrusions 136 may include a third protrusion 136C and a fourth protrusion 136D that is substantially parallel with the third protrusion 136D and a second bridge 136B that connects a distal (or second end) of the third protrusion 136C to a distal (or second end) of the fourth protrusion 136D. A proximal (or first) end of the third protrusion 136C may be connected to the recessed portion 134 and the distal end of the third protrusion 136C may extend towards the second body end 194. A proximal (or first) end of the fourth protrusion 136D may be connected to the recessed portion 134 and the distal end of the fourth protrusion 136D may extend towards the second body end 194.

In at least one example embodiment, the configuration of the outlet 196, including, for example, the recessed portion 134, the one or more protrusions 136, and the one or more bridges 138 may define a trough (or trap) 140 around an interior surface of the outlet 196. For example, the trough 140 may be defined by a space between an interior-facing surface of the horizontal surface 110 and the recessed portion 134 and/or the one or more protrusions 136. The trough 140 may be configured to trap or retain condensation such that the condensation does not exit through the outlet 196.

Figure 10:
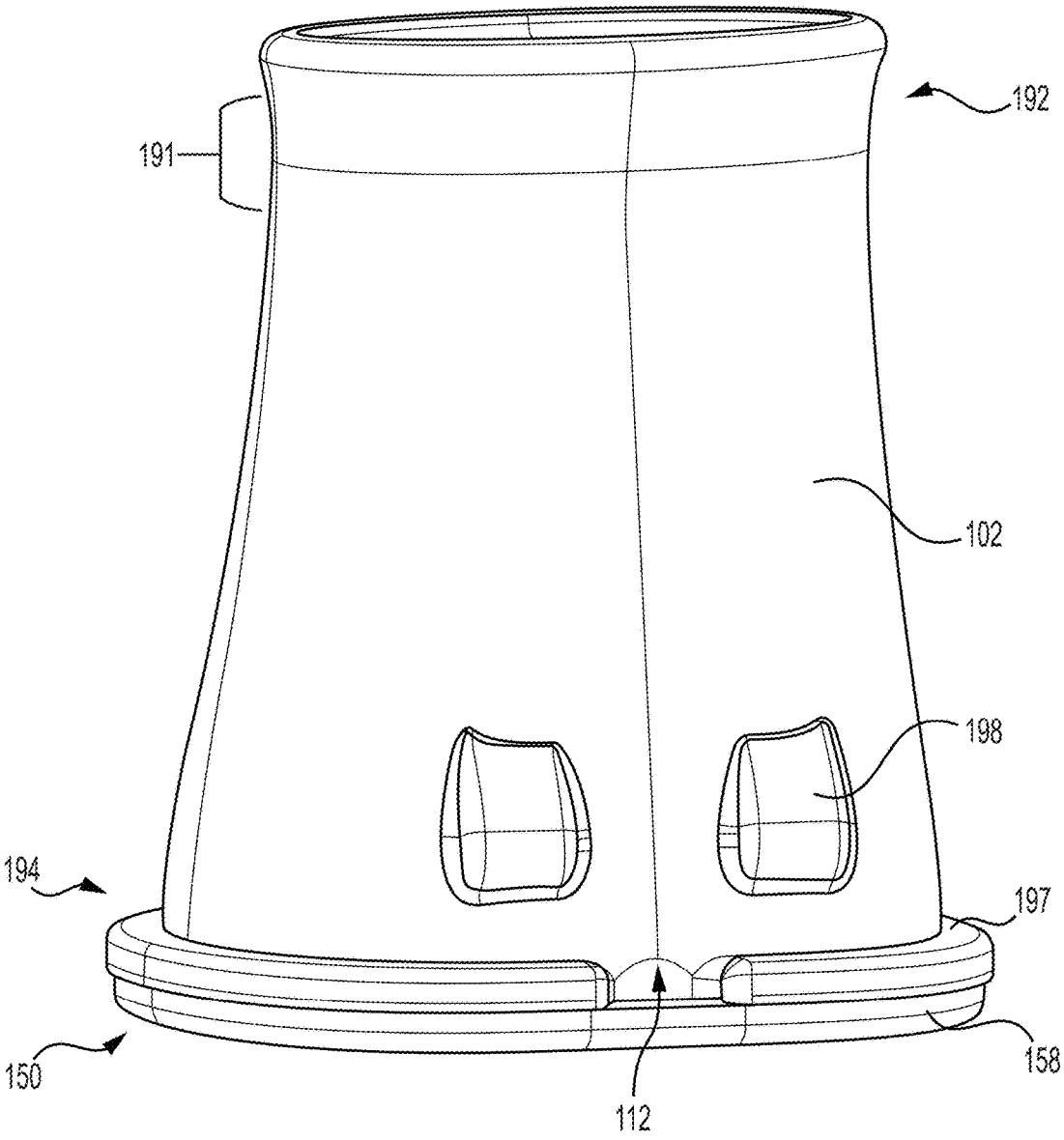
FIG. 10 is a front view of another example replaceable mouthpiece to be used in an aerosol-generating device in accordance with at least one example embodiment.
Figure 11:
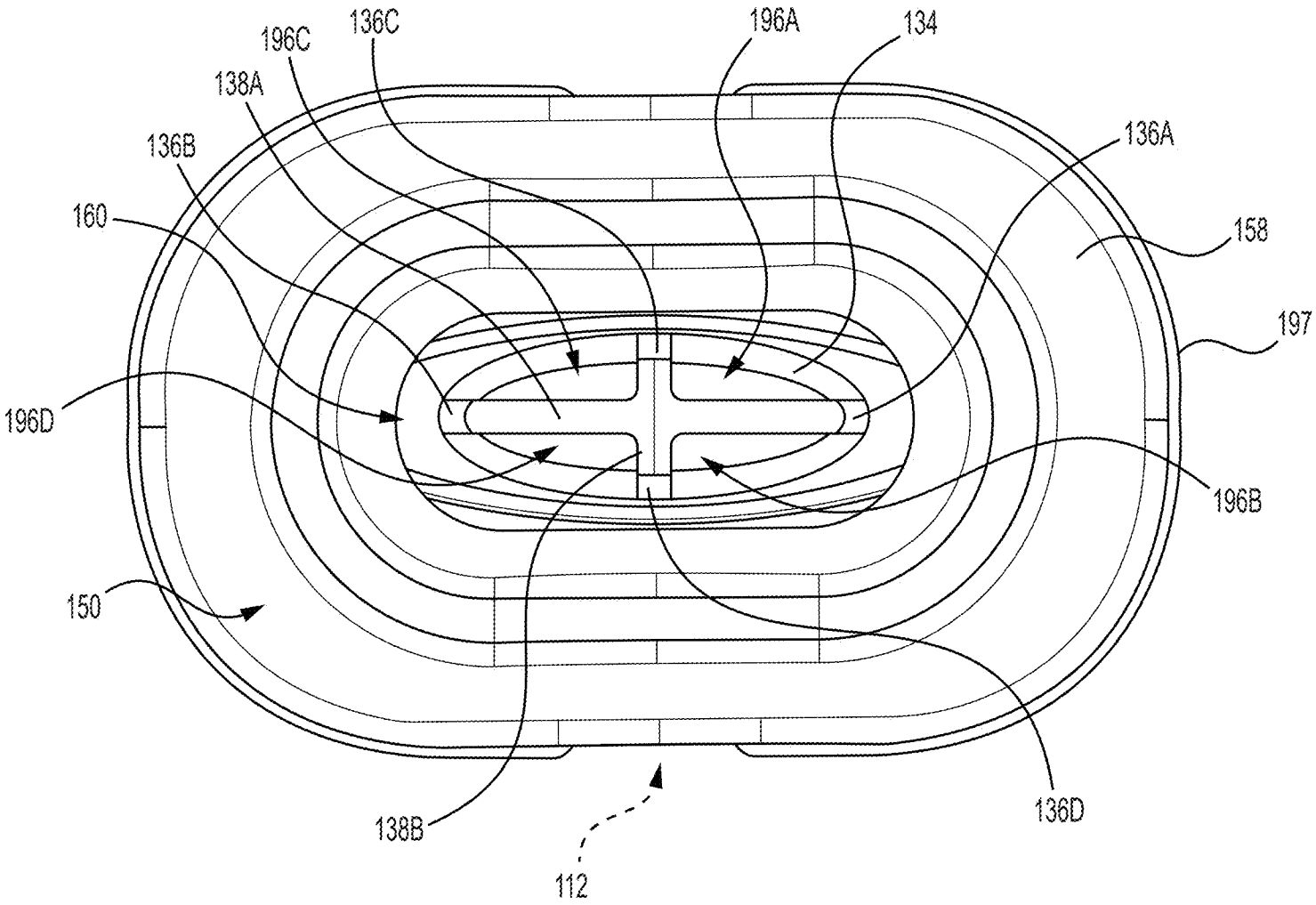
FIG. 11 is a bottom view of the example replaceable mouthpiece illustrated in FIG. 10.
Figure 12:
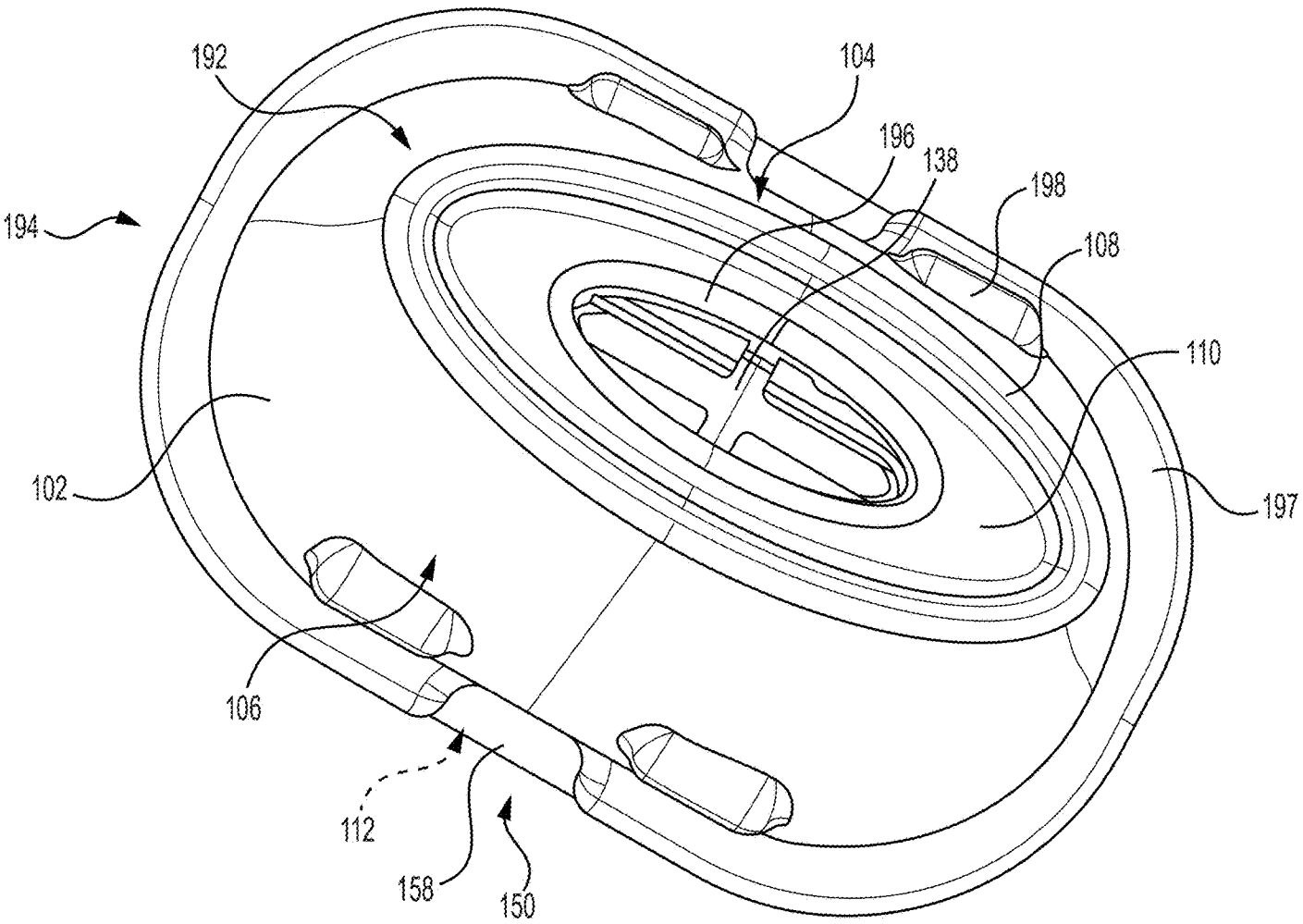
FIG. 12 is a top-down perspective view of the example replaceable mouthpiece illustrated in FIG. 10.
Figure 13:
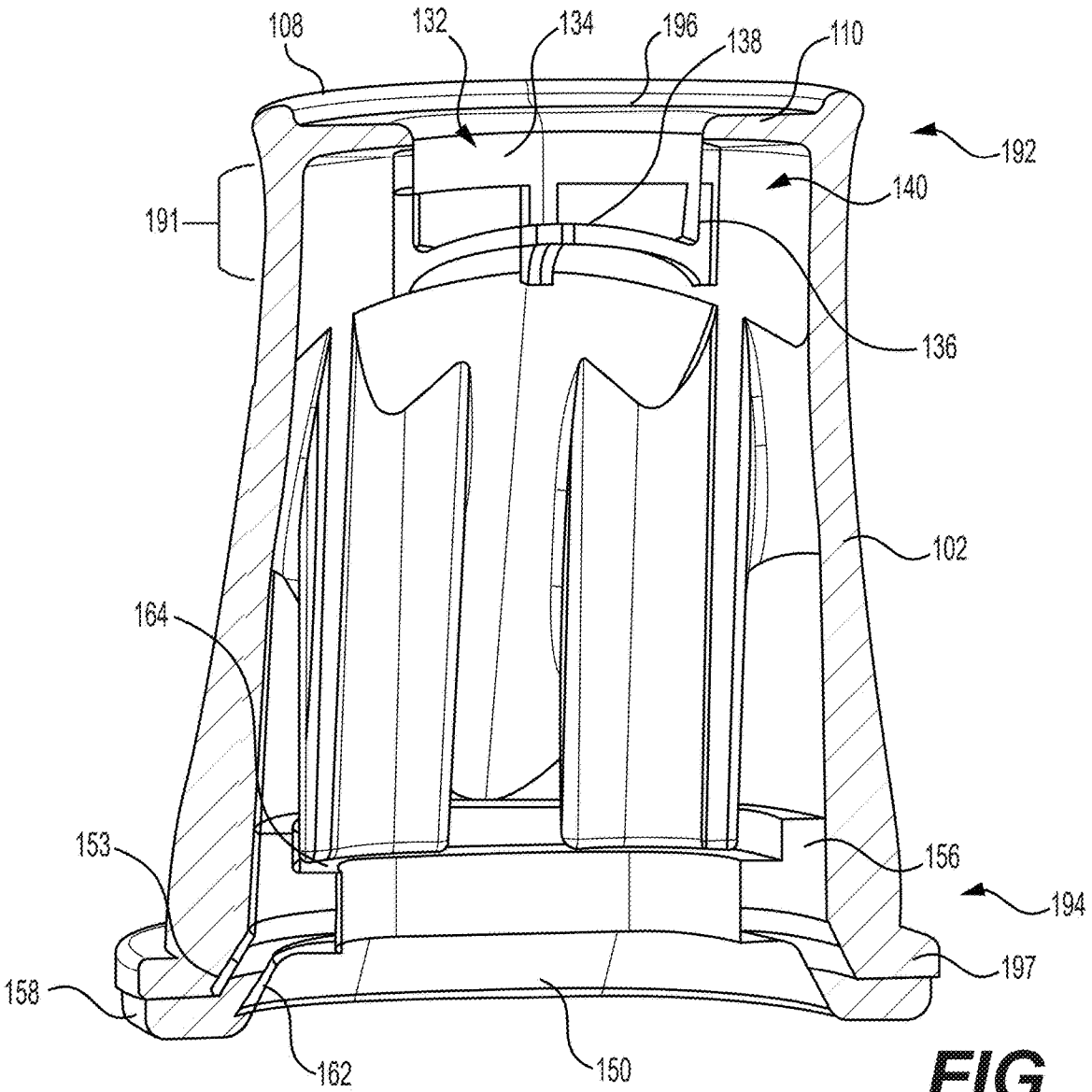
FIG. 13 is a cross-sectional view of the example replaceable mouthpiece illustrated in FIG. 10.

FIG. 10 is a front view of the replaceable mouthpiece 100 including a mouthpiece seal 150; FIG. 11 is a bottom-up view of the replaceable mouthpiece 100 including the mouthpiece seal 150; FIG. 12 is a top-down perspective view of the replaceable mouthpiece 100 including the mouthpiece seal 150; and FIG. 13 is a cross-sectional view of the replaceable mouthpiece 100 including the mouthpiece seal 150. As illustrated, in at least one example embodiment, the replaceable mouthpiece 100 may include (e.g., in communication with) a mouthpiece seal 150. The mouthpiece seal 150 may be a gasket that helps to form an air seal between the replaceable mouthpiece 100 and the aerosol-generating device. For example, as best shown in FIGS. 13 and 14 discussed below, a first side 152 of the mouthpiece seal 150 may be in communication with (e.g., sealed against) the replaceable mouthpiece 100 and the second side 154 of the mouthpiece seal 154 may be in communication with (e.g., sealed against) the aerosol-generating device when the replaceable mouthpiece 100 is received by the lid of the aerosol-generating device and the lid is in a closed position relative to a body of the aerosol-generating device.

Figure 14:
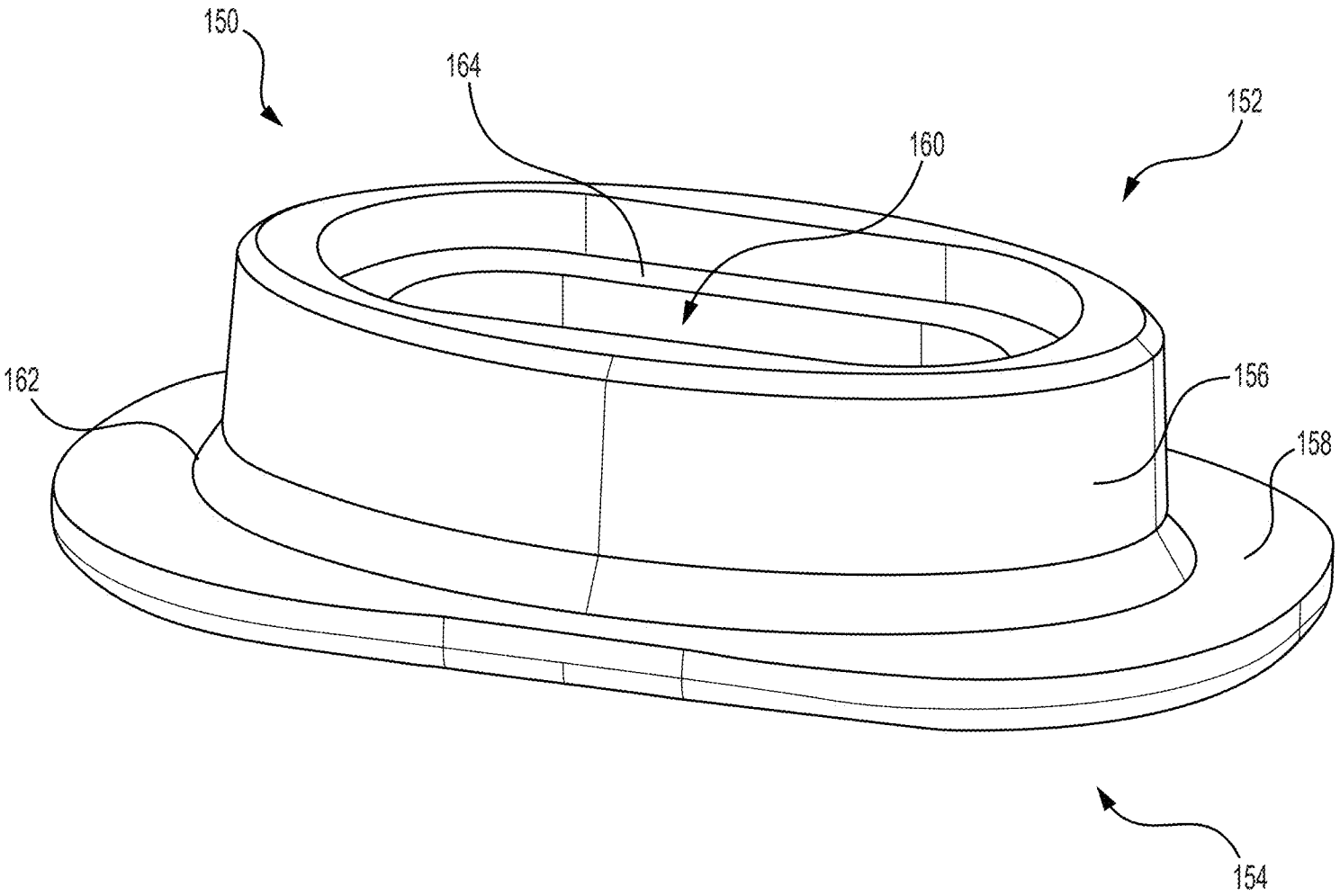
FIG. 14 is a top right, front perspective view of an example seal as used with the example replaceable mouthpiece illustrated in FIG. 10.
Figure 15:
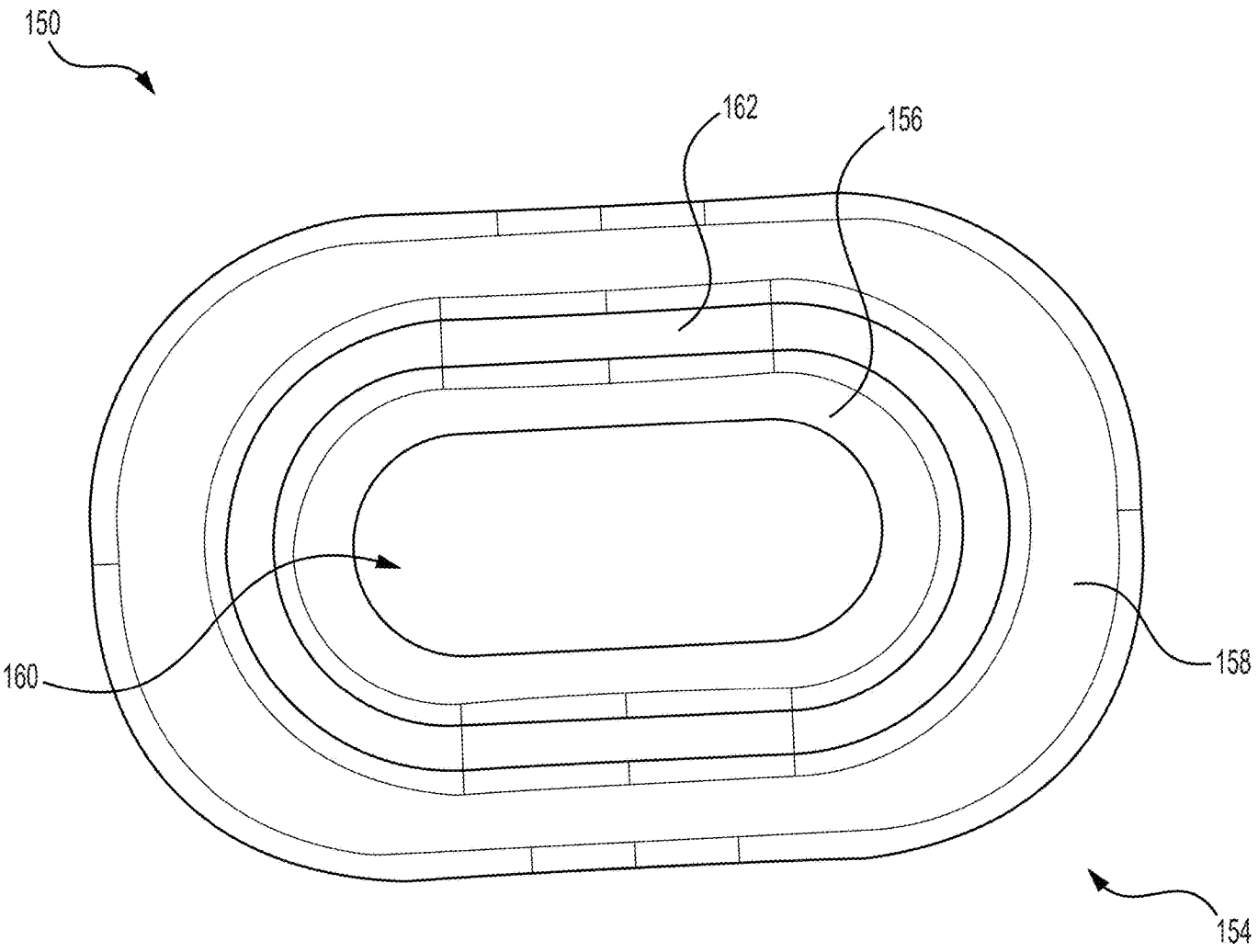
FIG. 15 is a bottom view of the example seal illustrated in FIG. 14.
Figure 16:
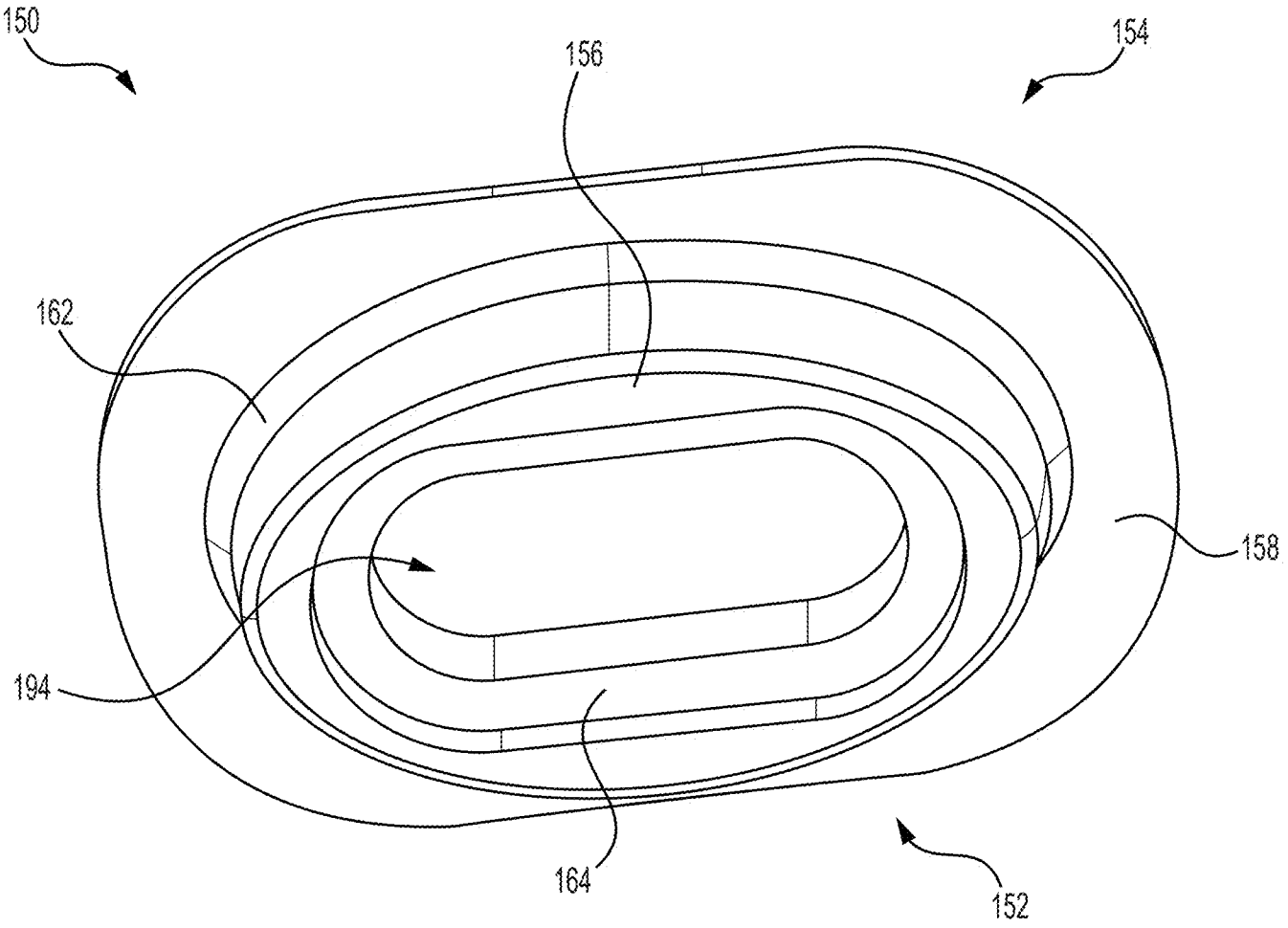
FIG. 16 is a top right, rear perspective view of the example seal illustrated in FIG. 14.
Figure 17:
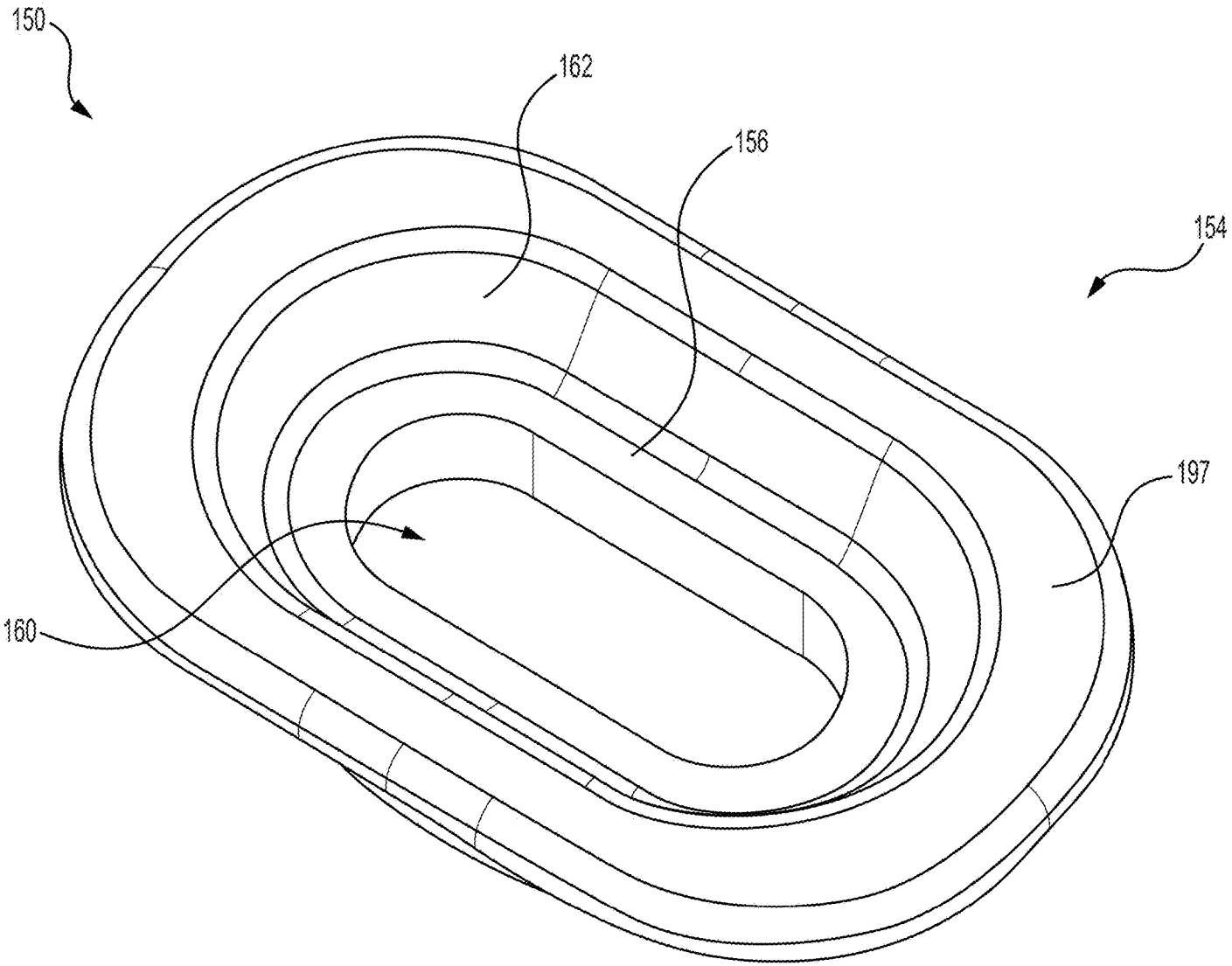
FIG. 17 is a bottom perspective view of the example seal illustrated in FIG. 14.

FIG. 14 is a top right, front perspective view of the mouthpiece seal 150; FIG. 15 is a bottom view of the mouthpiece seal 150; FIG. 16 is a top right, rear perspective view of the mouthpiece seal 150; and FIG. 17 is a bottom perspective view of the mouthpiece seal 150. As illustrated, the mouthpiece seal 150 may include a ridge 156 that defines a seal (or second) opening (or channel) 160 and a lip 158 that extends substantially perpendicularly from the ridge 156. The seal opening 160 may have an average diameter that is smaller than an average diameter of the opening 152 of the second body end 194. The diameter of the seal opening 160, however, is increased or maximized so as to reduce the overall surface area in contact with the aerosol stream and reduce condensation.

In at least one example embodiment, the mouthpiece seal 150 fits within an opening 152 at the second body end 194 of the replaceable mouthpiece 100. In at least one example embodiment, the opening 152 may include one or more angled surfaces 153 configured to guide the placement of and/or to securely hold the mouthpiece seal 150. In at least one example embodiment, the ridge 156 may include one or more angled surfaces 162 leading to the lip 158 and having shapes corresponding the one or more angled surfaces 153 of the second body end 194 of the replaceable mouthpiece 100 to help guide the placement of the mouthpiece seal 150 relative to the second body end 194 of the replaceable mouthpiece 100.

In at least one example embodiment, the lip 158 may align with a bottom-facing surface of the ledge 197 of the replaceable mouthpiece 100. For example, the lip 158 may form a continuous structure that aligns with the bottom-facing surface of the ledge 197 bridging, for example, the one or more breaks 112 disposed along the length of the ledge 197. Although not illustrated, it should be recognized that, in some example embodiments, the lip 158 may form a discontinuous structure that aligns with the bottom-facing surface of the ledge 197.

In at least one example embodiment, the two or more pillars 120 may be configured to contact at least a portion of the ridge 156. For example, in at least one example embodiment, as illustrated, the ridge 156 may include an interior shelf (or step) 164 that ends along at least a portion of an interior perimeter of the ridge 156. As illustrated, the shelf 164 may be a substantially continuous structure that extends along an entire length of the interior perimeter of the ridge 156. Although not illustrated, it should be recognized that, in some example embodiment, the shelf 164 may be a discontinuous structure that aligns, for example, with the two or more pillars 120. In each instance, the two or more pillars 120 in combination with the shelf 164 may work together to apply a pressure to the capsule received by the aerosol-generating device.

In at least one example embodiment, the replaceable mouthpiece 100 may be formed, for example, from a metal (such as aluminum, stainless steel, and the like); an aesthetic, food contact rated plastic (such as, a polycarbonate (PC), acrylonitrile butadiene styrene (ABS) material, liquid crystalline polymer (LCP), a copolyester plastic, or any other suitable polymer and/or plastic); and/or plant-based materials (such as wood, bamboo, pulp, and the like). In at least one example embodiment, the seal 150 may be formed, for example, from silicone, pulp, fluorosilicone, nitrile, neoprene, rubber, butyl, silicone sponge, or any combination thereof.

While some example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

Although described with reference to specific examples and drawings, modifications, additions, and substitutions of example embodiments may be variously made according to the description by those of ordinary skill in the art. For example, the described techniques may be performed in an order different with that of the methods described, and/or elements such as the described system, architecture, devices, circuit, and the like, may be connected or combined to be different from the above-described methods, or results may be appropriately achieved by other elements or equivalents.

We claim:

1. A replaceable mouthpiece for an aerosol-generating device, the replaceable mouthpiece comprises:

a body including a first body end defining an outlet, and a second body end defining a first opening coupleable to the aerosol-generating device, the outlet including one or more projections extending from the first body end towards the second body end, the one or more projections including first, second, third, and fourth protrusions extending from the first body end towards the second body end;

a first bridge having a first center point connecting the first protrusion and the second protrusion; and a second bridge having a second center point connecting the third protrusion and the fourth protrusion, the second center point intersecting with the first center point; and two or more pillars disposed within the body and extending towards the second body end, each of the two or more pillars has a first pillar end and a second pillar end, the first pillar end being coupled to and extending from an interior surface of the body at the first body end, the second pillar end being a free end that is not attached to the body.

2. The replaceable mouthpiece of claim 1, wherein the replaceable mouthpiece includes four pillars that together form a discontinuous shape that mirrors a shape of the outlet.

3. The replaceable mouthpiece of claim 1, wherein the replaceable mouthpiece further comprises a seal defining a second opening, the seal configured to engage the second body end such that the first opening and the second opening at least partially align.

4. The replaceable mouthpiece of claim 3, wherein the seal includes a ridge that defines the second opening and a lip that extends perpendicularly from the ridge.

5. The replaceable mouthpiece of claim 4, wherein the ridge is received by the second body end and the lip joins a ledge of the replaceable mouthpiece that is configured to position the replaceable mouthpiece with respect to the aerosol-generating device.

6. The replaceable mouthpiece of claim 5, wherein the lip is parallel with the ledge of the replaceable mouthpiece.

7. The replaceable mouthpiece of claim 5, wherein the two or more pillars are configured to contact at least a portion of the ridge when the seal is received by the second body end.

8. The replaceable mouthpiece of claim 5, wherein the ridge includes a shelf that extends along an interior perimeter of the ridge.

9. The replaceable mouthpiece of claim 8, wherein the two or more pillars are configured to contact the shelf at one or more locations.

10. The replaceable mouthpiece of claim 1, wherein the one or more projections include a recessed portion extending along a perimeter of the outlet and the first, second, third, and fourth protrusions extend from the recessed portion towards the second body end.

11. The replaceable mouthpiece of claim 1, wherein the first bridge is concave with respect to the outlet.

12. The replaceable mouthpiece of claim 1, wherein the second bridge is concave with respect to the outlet.

13. The replaceable mouthpiece of claim 1, the first body end includes a rim that ends along a perimeter of the first body end and a recessed surface extending inwardly from the rim and defining the outlet.

14. The replaceable mouthpiece of claim 1, wherein the body further includes one or more coupling structures disposed on an exterior surface of the body and configured to couple the replaceable mouthpiece to a lid of the aerosol-generating device.

* * * * *